US006164753A

United States Patent [19]

Maza et al.

[11] Patent Number: 6,164,753

[45] Date of Patent: Dec. 26, 2000

[54] OPTICAL SENSOR SYSTEM TO CALIBRATE A PRINTHEAD SERVICING LOCATION IN AN INKJET PRINTER

[75] Inventors: Jesus Garcia Maza; Martin Urrutia; Jose Jurjo Soleda, all of Barcelona, Spain

[73] Assignee: Hewlett-Packard Company

[21] Appl. No.: 09/031,115

[22] Filed: Feb. 26, 1998

[51] Int. Cl.[7] ..... B41J 2/165; B41J 29/393

[52] U.S. Cl. ..... 347/32; 347/19; 347/37

[58] Field of Search ..... 347/19, 32, 37, 347/30, 33, 28, 217; 400/705, 703, 237

[56] References Cited

U.S. PATENT DOCUMENTS 4,686,540 8/1987 Leslie et al. ..... 347/39
4,728,970 3/1988 Terasawa ..... 347/30
4,791,435 12/1988 Smith et al. ..... 347/35
5,796,414 8/1998 Sievert et al. ..... 347/19

*Primary Examiner*—N. Le
*Assistant Examiner*—Thien Tran

[57] ABSTRACT

A method and apparatus are provided for aligning the printer carriage of an inkjet printer with a service station of the printer where for example capping, wiping or spitting of inkjet cartridges held by the printer carriage can be performed. The method utilizes an optical sensor mounted on the printer carriage to scan a reference mark within the service area. Preferably the reference mark exhibits a change in reflectance in the scanning direction of the printer carriage and is mounted on a service station carriage which also holds removable service modules. An embodiment employs an iterative method in which calibration steps are interspersed by capping operations so as to ensure accurate alignment is achieved.

9 Claims, 17 Drawing Sheets

OPTICAL SENSOR SYSTEM TO CALIBRATE A PRINTHEAD SERVICING LOCATION IN AN INKJET PRINTER

CROSS-REFERENCE TO RELATED APPLICATIONS

The present application is related to the following co-pending commonly assigned applications, all of which are incorporated herein by reference: U.S. Ser. No. 08/811,405 filed Mar. 4, 1997 by Brian Canfield et al entitled MANUALLY REPLACEABLE PRINTHEAD SERVICING MODULE FOR EACH DIFFERENT INKJET PRINTHEAD, U.S. Ser. No. 08/810,485 by Rick Becker et al, filed on Mar. 3, 1997 entitled INKJET PRINTING WITH REPLACEABLE SET OF INK-RELATED COMPONENTS (PRINTHEAD/SERVICE MODULE/INK SUPPLY) FOR EACH COLOR OF INK, U.S. Ser. No. 09/032,386 entitled INKJET PRINTHEAD CAPPING METHOD AND APPARATUS filed Feb. 26, 1998, by Jesus Garcia Maza.

FIELD OF THE INVENTION

The present invention relates to the positioning of inkjet cartridges held in the printer carriage of an inkjet printer relative to a service station of the printer for performing servicing functions on the cartridges.

BACKGROUND TO INVENTION

Inkjet cartridges are now well known in the art and generally comprise a body containing an ink supply and having electrically conductive interconnect pads thereon and a printhead for ejecting ink through numerous nozzles in a printhead. In thermally activated inkjet cartridges, each cartridge has heater circuits and resistors which are energised via electrical signals sent through the interconnect pads on the cartridge. Each inkjet printer can have a plurality, often four, of cartridges each one having a different colour ink supply for example black, magenta, cyan and yellow, removably mounted in a printer carriage which scans backwards and forwards across a print medium, for example paper, in successive swaths. When the printer carriage correctly positions one of the cartridges over a given location on the print medium, a jet of ink is ejected from a nozzle to provide a pixel of ink at a precisely defined location. The mosaic of pixels thus created provides a desired composite image.

Inkjet cartridges are increasingly becoming more sophisticated and complex in their construction and longer lifetimes are also required of cartridges, particularly those for use with printers having an off-carriage ink reservoir which replenishes the cartridge's ink supply. This has lead to greater sophistication in the so-called "servicing" of cartridges by a printer. It is normal for printers to have a service station at which various functions are performed on the cartridges while they are mounted in the printer carriage such as wiping, spitting and capping, see for example U.S. Pat. No. 5,585,826. Wiping comprises moving a wiper of a specified material across the printhead of a cartridge to remove paper dust, ink spray and the like from the nozzle plate of the printhead. Spitting, ejecting ink into a spittoon in the service station, is performed to prevent ink in nozzles which have not been fired for some time from drying and crusting. Cartridges are capped by precisely moving the printer carriage, and normally the cap too, within the service station, so that the cap mates with the printhead of the cartridge and forms a seal around the nozzle plate. Capping prevents ink on the printhead and in the nozzles from drying by providing the correct atmosphere around these components and thus reduces the risk of crusting and ink plug formation in the nozzles. Also the cartridge can often be primed while in the capped position by the application of a vacuum through the cap.

All of these servicing functions require that the cartridges held in the printer carriage are accurately located within the service station area of the printer relative to the servicing components. There are various prior art means known for mechanically aligning the printer carriage with service components such as caps, wipers and spittoons. For example, U.S. Pat. No. 5,563,638 by Osbourne entitled INK-JET PRINTHEAD CAPPING AND WIPING METHOD AND APPARATUS describes a sled on which is mounted a plurality of caps and wipers. The sled is cam-coupled to the printer chassis and also to the printer carriage so that movement of the printer carriage along its scanning axis produces relative movement and alignment between the cartridges held in the printer carriage and the servicing components held on the sled. As the servicing functions required within an inkjet printer become more sophisticated there is a requirement for greater accuracy in the alignment of cartridge printheads with the servicing components. Also, to facilitate a greater degree of flexibility in the design of service components there is a requirement that their alignment to the printer carriage is achieved other than by the movement of these components by the printer carriage. This is an especial requirement when the servicing components are intended to be manually removable by a user of the printer.

BRIEF SUMMARY OF THE INVENTION

The present invention provides apparatus for aligning one or more inkjet cartridges held within a scanning printer carriage of an inkjet printer with a service station area within the printer where servicing functions are performed on the cartridges by servicing components. The apparatus comprises means for determining the position of the printer carriage along its scanning direction (such as an encoder strip), an optical sensor mounted on the printer carriage and a reference mark at a known location relative to the servicing components within the service station area, which reference mark is optically detectable by the optical sensor. Although an optical sensor mounted on the printer carriage of an inkjet printer is known to be useful for a number of purposes related to the scanning of test patterns printed in the print zone of the printer, the present invention extends the usefulness of such an optical sensor to service station location functions. The optical sensor allows the printer carriage to be accurately aligned within the service station area without making physical contact with any of the servicing components. Since the printer carriage needs to be moved with a high degree of positional accuracy in the scanning direction for printing purposes, very few additional components are generally required to implement the service station location system of the present invention.

Preferably, the optical sensor is able to distinguish between the reflectance of sensed objects and the reference mark comprises at least one, preferably two, changes of reflectance in the scanning direction of the printer carriage.

Location systems according to embodiments of the present invention are particularly advantageous when the servicing components of a printer are provided via service modules adapted to be manually removable from the service station carriage by a user of the inkjet printer. In this case the service station modules may be designed without the need to provide additional facilities for alignment with the printer carriage in the scanning direction since this is performed in a non-contact manner.

According to a further aspect of the present invention there is provided a method of locating a scanning printer carriage of an inkjet printer relative to a service station area positioned at one end of the scanning axis of the printer carriage comprising the steps of activating an optical sensor mounted on the printer carriage, moving the printer carriage along in its scanning direction while optically sensing for a reference mark located within the service area and while monitoring the current position of the printer carriage along its scanning axis, locating the reference mark and storing for future use the position of the printer carriage at which the reference mark has been located.

Preferably the process of calibrating the location of the printer carriage is performed several times and between each calibration a capping operation, in which the cartridges held within the printer carriage are capped by caps within the service station area, is performed. Since there are generally some resilient components within the capping system, the use of an iterative location procedure which includes contact between the cartridges held by the printer carriage and the servicing components ensures that these components are allowed to find their natural positions during the location procedure.

A more complete understanding of the present invention and other objects, aspects, aims and advantages thereof will be gained from a consideration of the following description of the preferred embodiment read in conjunction with the accompanying drawings provided herein.

DETAILED DESCRIPTION OF THE PREFERRED EMBODIMENT OF THE INVENTION

Figure 1:
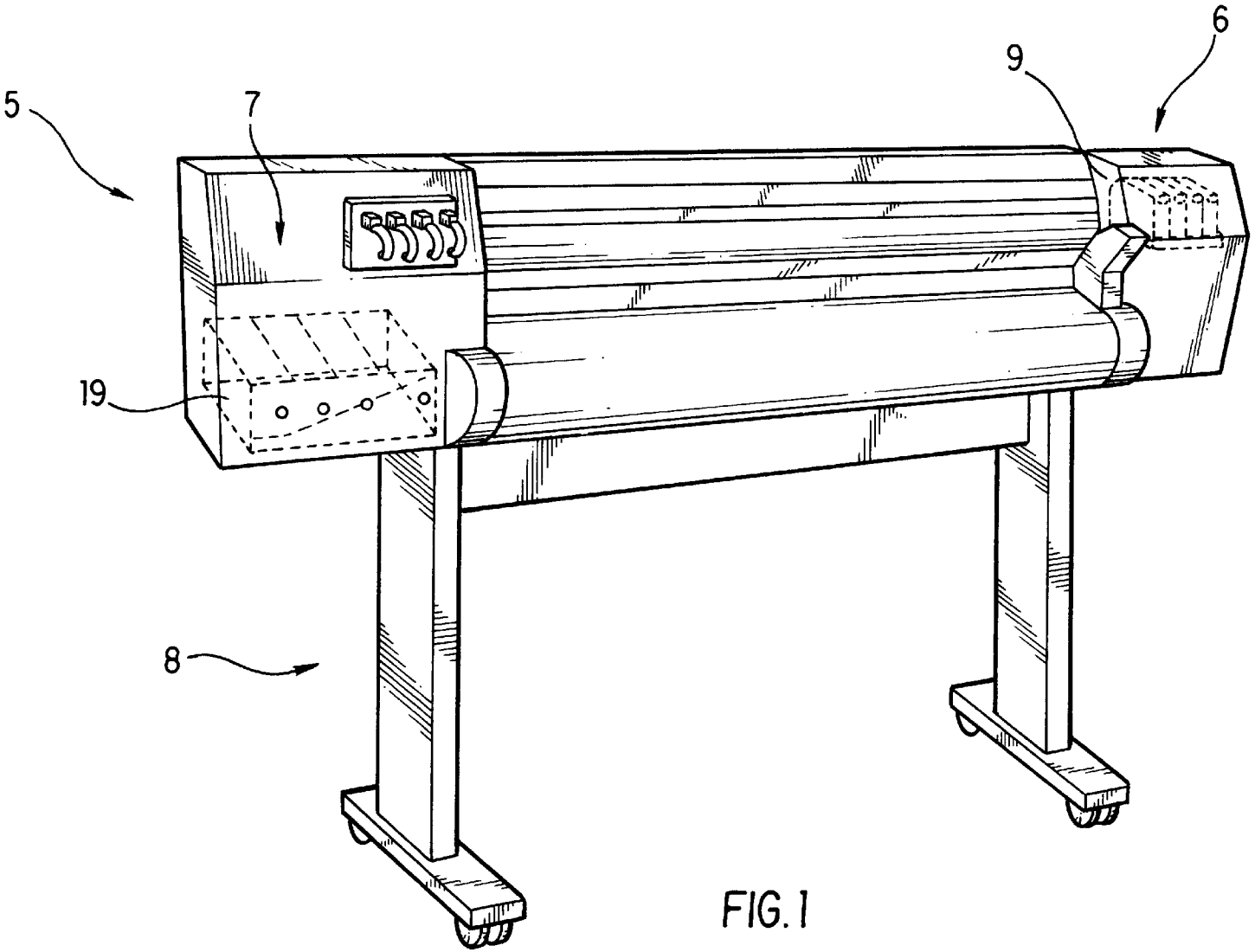
FIG. 1 is a perspective view of a large-format inkjet printer with which the location system of the present invention may be utilised.

While the present invention is open to various modifications and alternative constructions, the preferred embodiments shown in the drawings will be described herein in detail. It is to be understood, however, that there is no intention to limit the invention to the particular form disclosed. On the contrary, the intention is to cover all modifications, equivalences and alternative constructions falling within the spirit and scope of the invention as expressed in the appended claims.

It will be appreciated that the printer carriage to service station location system of the present invention may be used with virtually any inkjet printer, however one particular inkjet printer will first be described in some detail, before describing the location system of the invention.

FIG. 1 shows a perspective schematic view of a thermal inkjet large-format printer having a housing 5 with right and left covers respectively 6 and 7, mounted on a stand 8. A print media such as paper is positioned along a vertical or media axis by a media axis drive mechanism (not shown). As is common in the art, the media drive axis is denoted as the X axis and the printer carriage scan axis is denoted as the Y axis.

Figure 2:
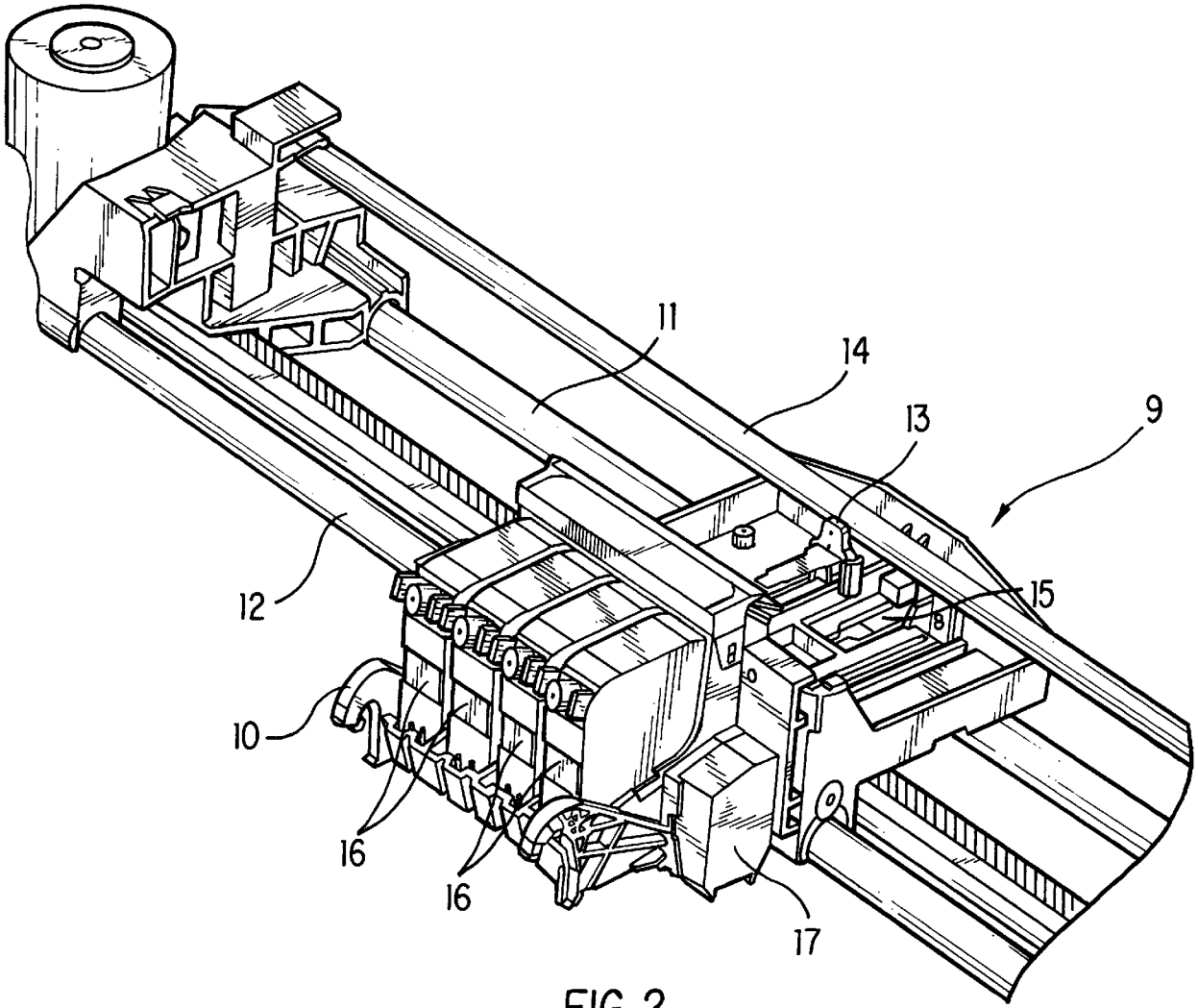
FIG. 2 is a schematic drawing of components within the print zone of the printer of FIG. 1.
Figure 3:
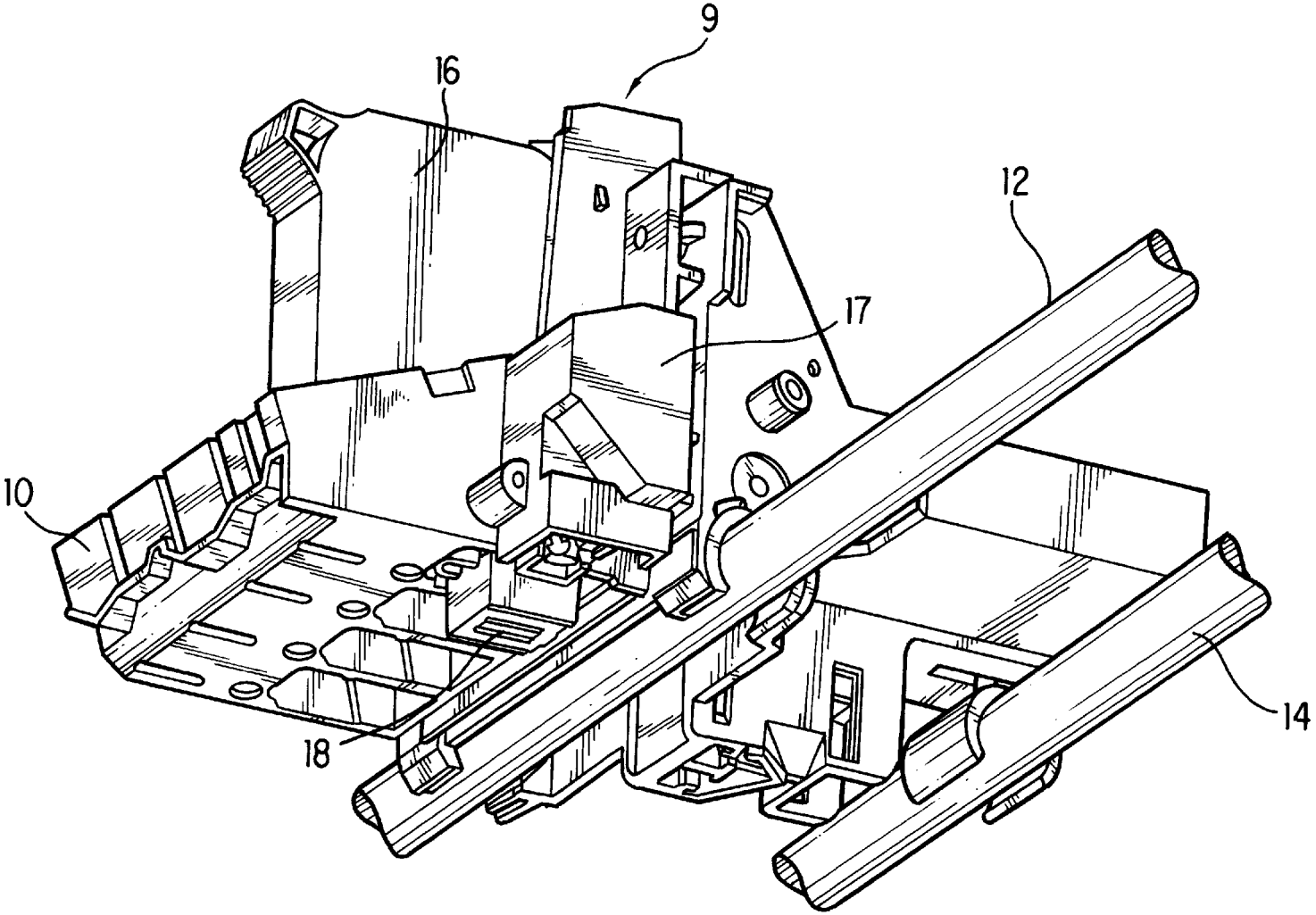
FIG. 3 is a side bottom view of the carriage assembly of the printer of FIG. 1.

The printer has a carriage assembly 9 shown in phantom under cover 6 and more clearly in FIG. 2 which is a perspective view of the print zone of the printer. The carriage assembly 9 has a body which is mounted for reciprocal movement along slider rods 11 and 12 and a printer carriage 10 for holding four inkjet cartridges 16 each holding ink of a different colour for example black, yellow, magenta and cyan. The cartridges are held in a close packed arrangement and each may be selectively removed from the printer carriage 10 for replacement by a fresh cartridge. The printheads of the cartridges 16 are exposed through openings in the printer carriage 10 facing the print media. On the side of the printer carriage 10 is mounted an optical sensor 17 which will be described in greater detail below. The carriage assembly body further retains an optical encoder 13 for determining the position of the printer carriage in the Y axis by interaction with an encoder strip 14, and the circuitry 15 required for interface to the heater circuits in the inkjet cartridges 16. FIG. 3 is a side-bottom perspective view of the carriage assembly 9 which better shows the mounting of the carriage and the protrusion of a printhead 18 of an inkjet cartridge 16 through the printer carriage 10 towards the print media.

Figure 6A:
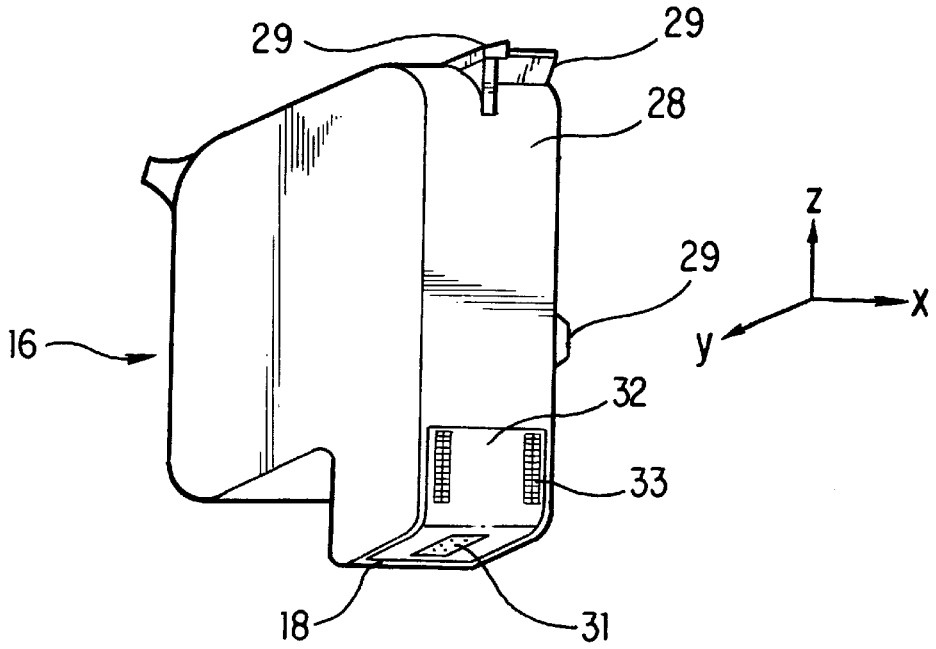
FIGS. 6A and 6B show an inkjet cartridge which may be used with the location system of the present invention.
Figure 6B:
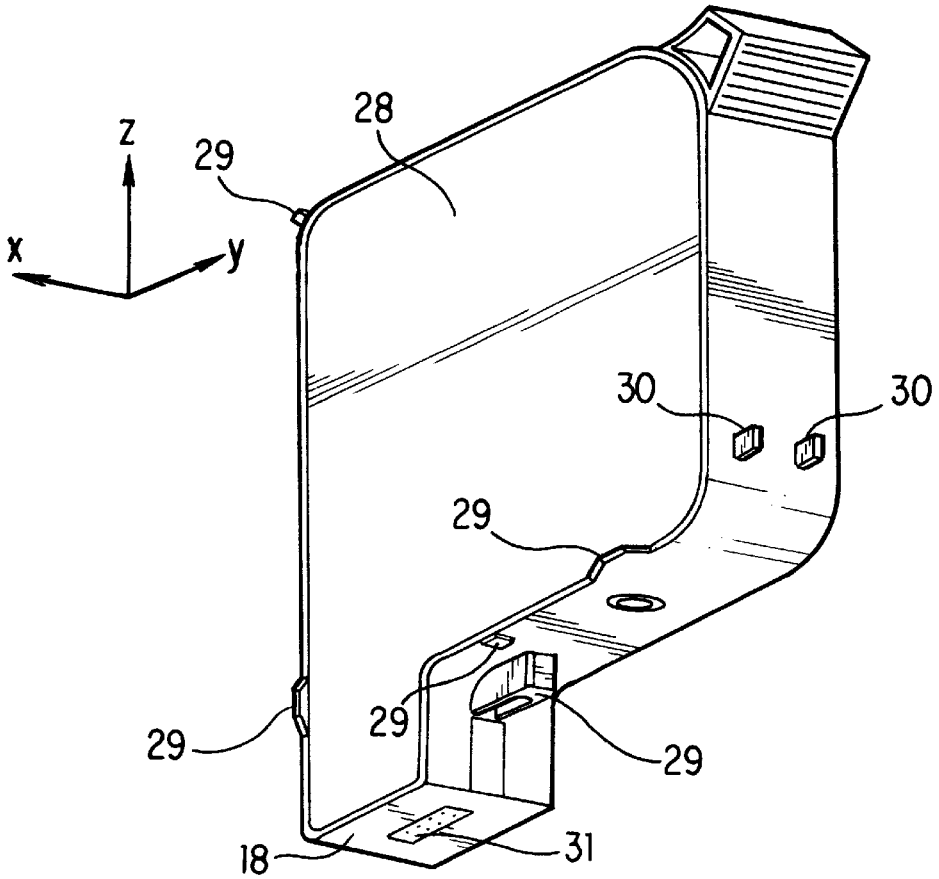

FIGS. 6A and 6B show details of an inkjet cartridge 16 which can be used with the printer shown in FIG. 1. The cartridge has a body 28 having an internal ink supply and various alignment features or datums 29, and keying elements 30. The printhead 18 has a nozzle plate 31 and an insulating tape 32 having, electrically conductive interconnect pads 33 thereon.

Figure 4:
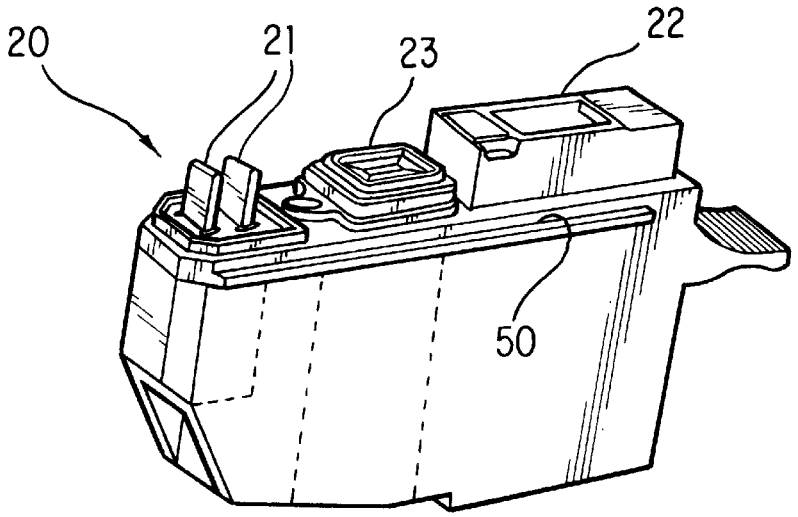
FIG. 4 is a perspective view of a service module having a cap, wipers and a spittoon which may be used with the location system of the invention.

Referring again to FIG. 1 the printer has a set of replaceable ink supply modules 19 in the lefthand side of the printer (shown in phantom under the cover 7) and a set of replaceable service station modules mounted in the service station at the right-hand side of the printer (not shown). FIG. 4 shows a service station module 20 having three servicing components, namely dual wipers 21 at one end, a spittoon 22 at the other end and a cap 23 at an intermediate position. The printer has one service station module 20 per cartridge 16 and each service station module is mounted in a service station carriage 24, shown in FIG. 5, in the service station unit 25 of the printer. The service station carriage 24 has four slots 26 for receiving service modules 20. Each of the slots 26 of the service station carriage 24 has a Z datum ridge 51 (shown in FIG. 8) along a top portion of the slot which engages a corresponding datum ledge 50 (as shown in FIG. 4) along both top edges of the service module 20. Each slot 26 also comprises an upwardly biased spring arm (not shown) which ensures that each service module 20 snaps into place in its respective slot 26 and is held against the datum ridge 51.

Figure 5:
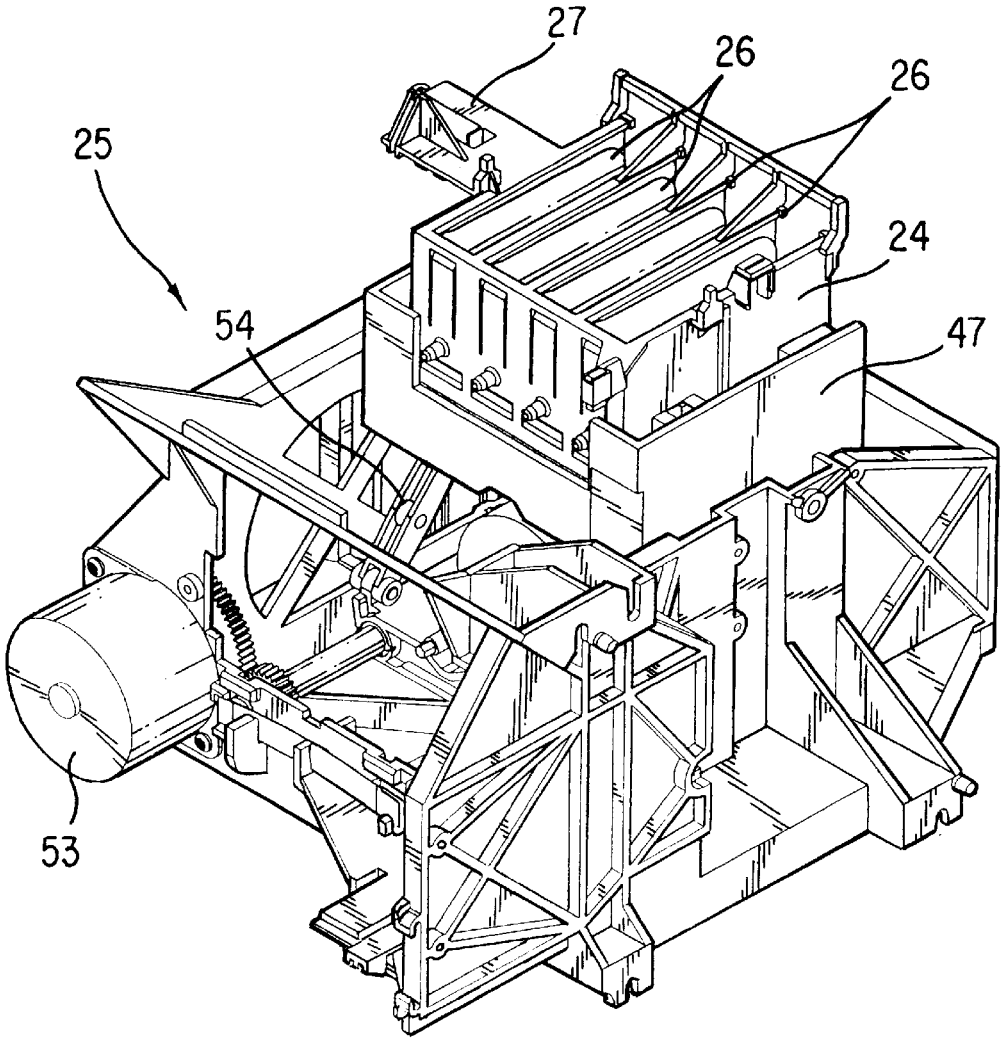
FIG. 5 is a perspective rear view of the service station unit of the printer of FIG. 1.
Figure 7:
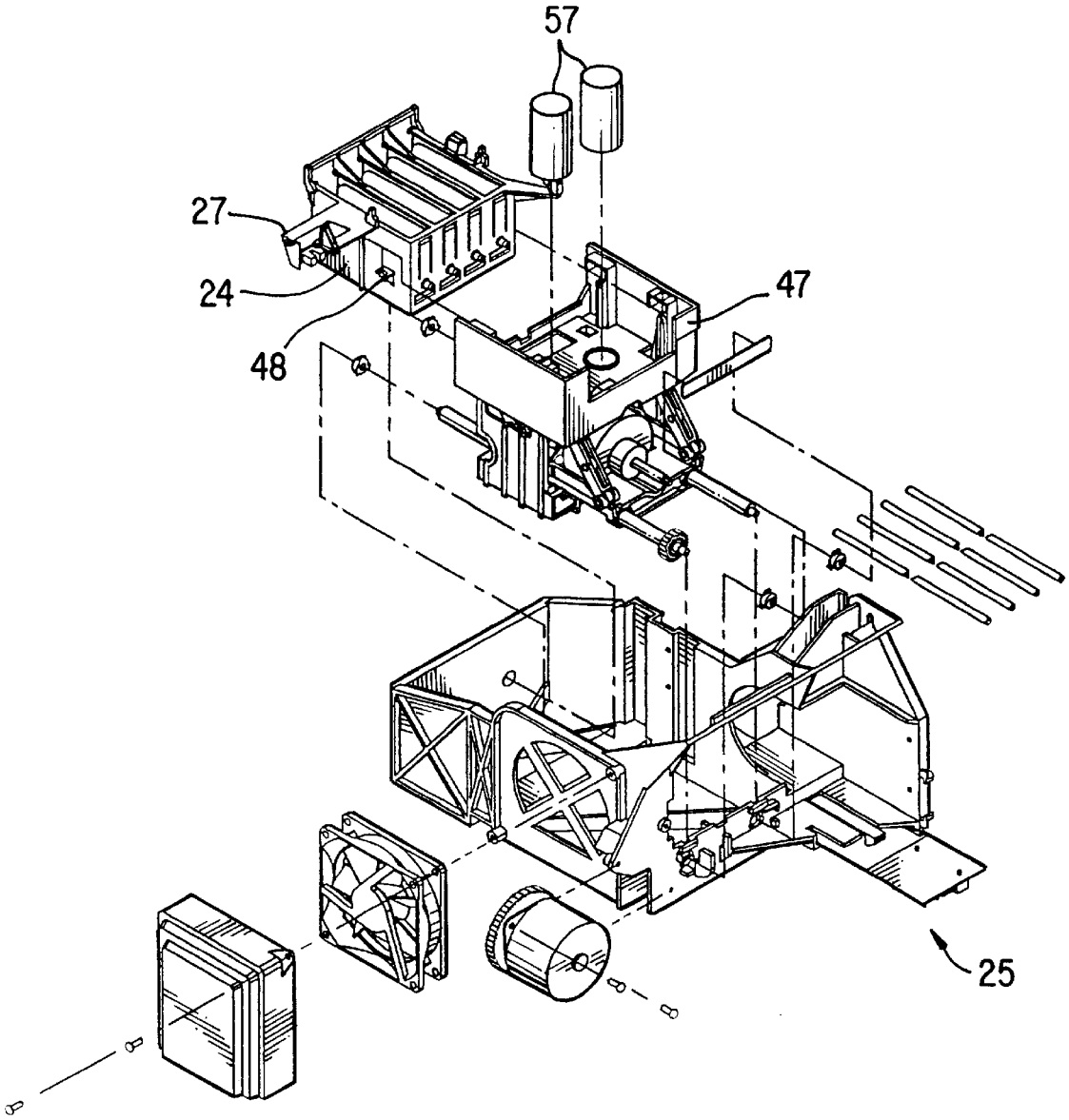
FIG. 7 is an exploded view of the service station unit of the printer of FIG. 1.

With reference to FIGS. 5 and 7, the service station carriage 24 is mounted within a service station assembly 47. As best seen in the exploded view of the service station unit 25 shown FIG. 7, the service station carriage 24 is mounted on two springs 57 within the service station assembly 47. The service station carriage 24 has four pegs 48, two extending from each of its outer side walls 49, (shown in FIG. 8) which abut downwardly facing arms 55 extending from the inner side walls 56 (shown in FIG. 9) of the service station assembly 47. The service station carriage 24 is upwardly biased by the springs 57 acting against its base 52 until the pegs 48 on its walls 49 contact the arms 55 of the service station assembly 47. This provides a "floating" mounting to the service station carriage 24 and allows it to gimbal to some extent to mate with the printer carriage 10 during capping.

Figure 9:
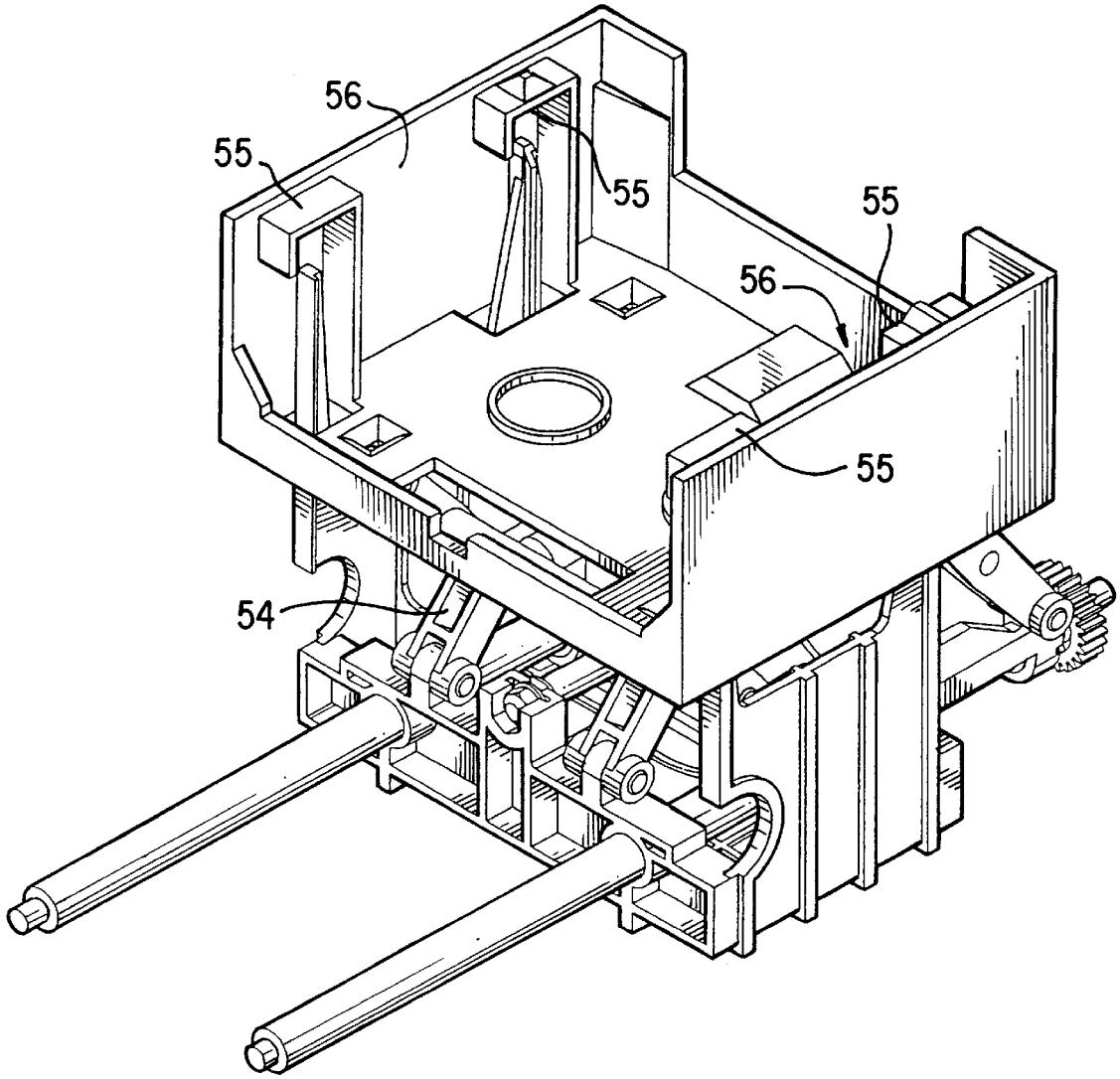
FIG. 9 shows a service station assembly on which the service station carriage of FIG. 8 is mounted.
Figure 10:
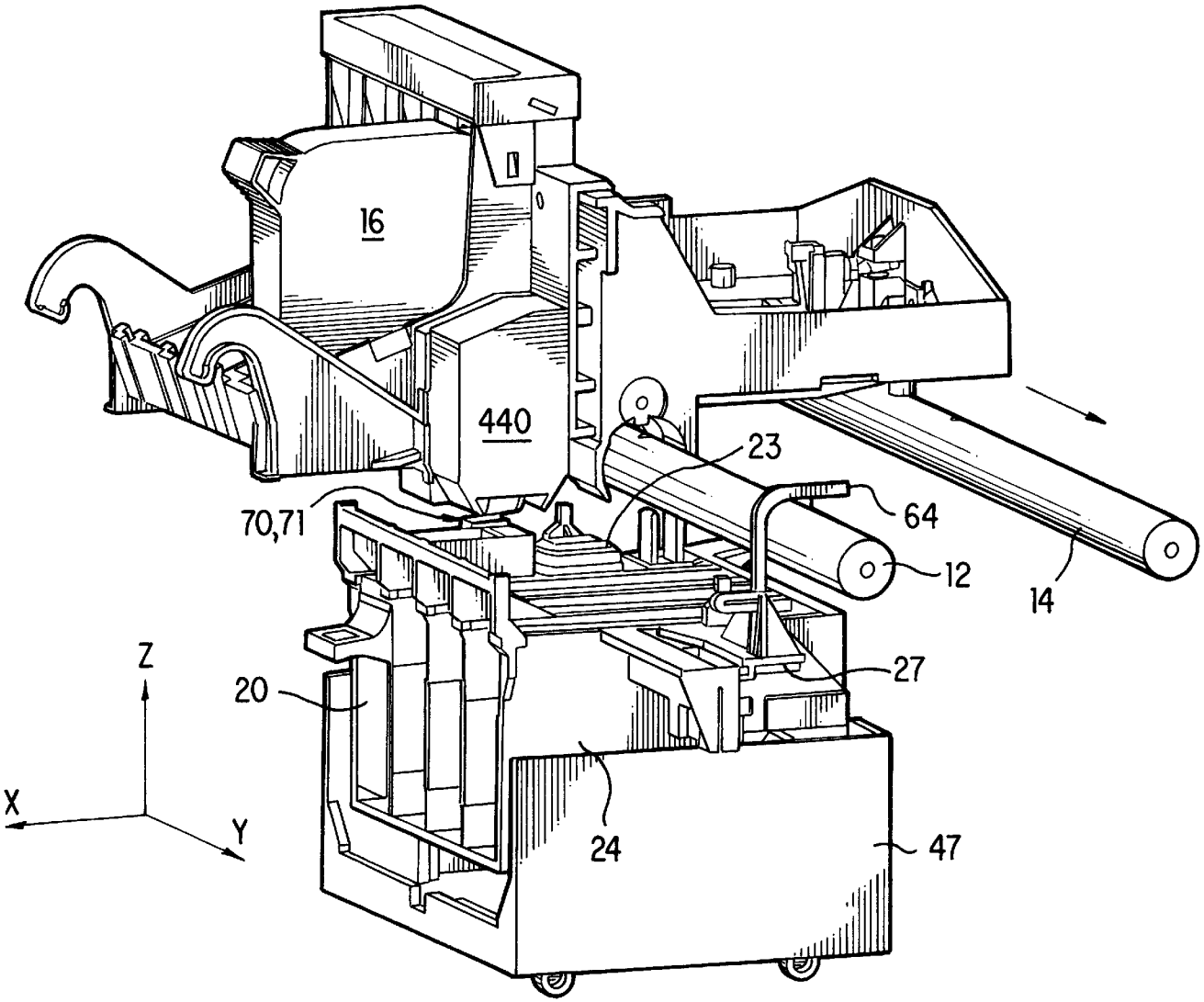
FIG. 10 shows the carriage assembly, including the printer carriage moving in the Y direction along slider rods to the right hand side of the printer where the service station is located.
Figure 11A:
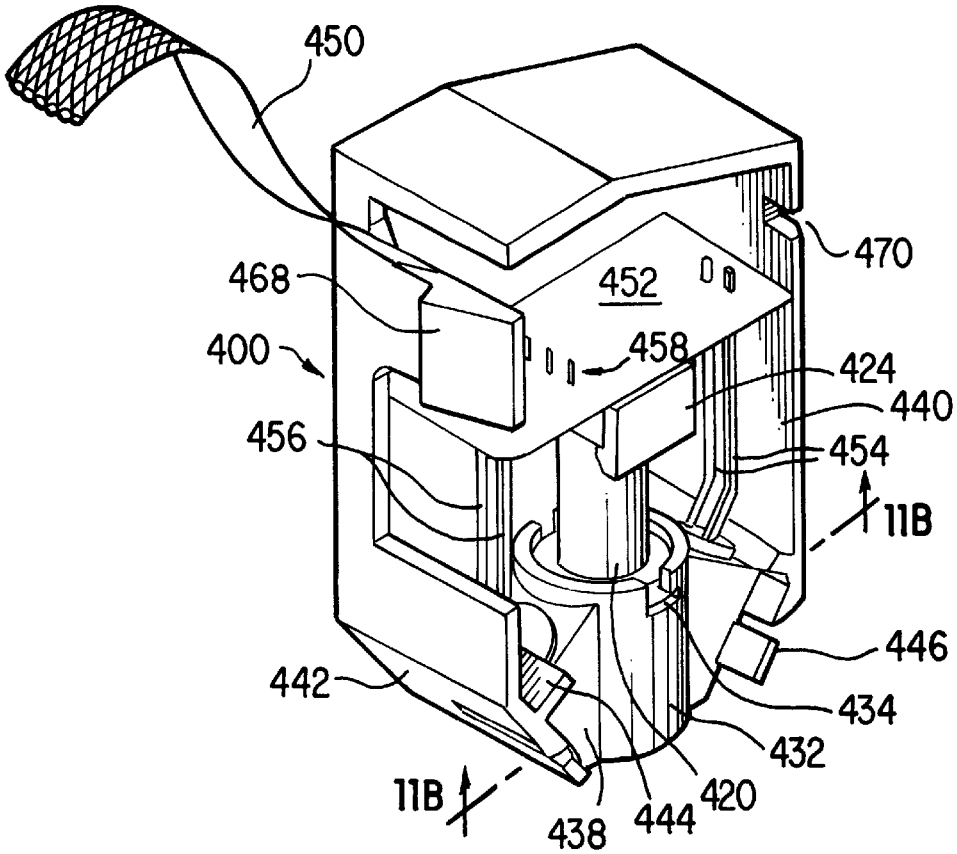
FIG. 11A is an isometric view showing the internal components of an optical sensor which is mountable on the printer carriage.
Figure 11B:
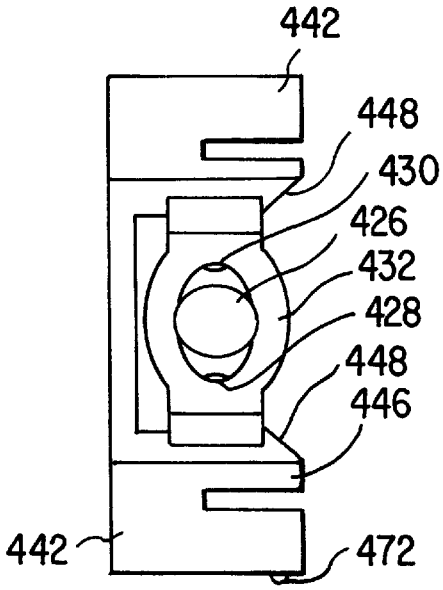
FIG. 11B is a bottom view of the optical sensor taken along the line 11B—11B of FIG. 11A.
Figure 12:
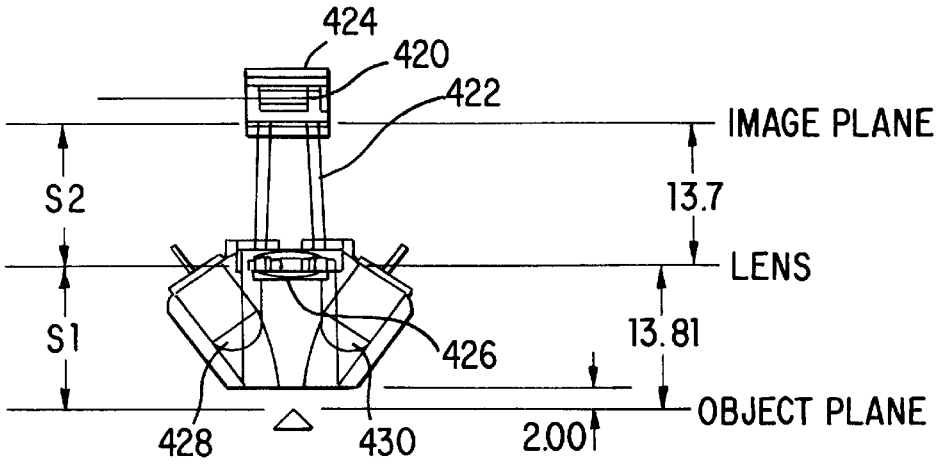
FIG. 12 is a front view of the components of the optical sensor of FIG. 11A.

The whole of the service station carriage 24 is moved in two directions, the K and Z directions, by the service station unit 25 so that various of the servicing components of the service modules 20 may be brought up to the printheads 18 of the cartridges 16 when required for servicing. Referring to FIGS. 5 and 9 the service station assembly 47 is movable in the X direction by a stepper motor 53 which drives a worm drive, and in the Z direction (i.e. the capping direction) by a second stepper motor (not shown) via a linkage 54. The position of the service station carriage 24 in the X and Z directions is determined by counting the steps taken by the stepper motors. This count is initialised in both the Z and the X directions by detecting the contact of a mechanical motion sensor, in the shape of an inverted L, 64 mounted on an arm 27 extending from the side of the service station carriage 24, with the front slider bar 12, as shown in FIG. 10. Since the printer carriage 10 is clearly well referenced to the slider bar (for printing purposes), by referencing the service station carriage location to the slider bar too the two carriages are well referenced to each other in the X and Z directions.

FIG. 10 shows the carriage assembly, including the printer carriage 10 (shown holding only one rather than four cartridges for clarity) moving in the Y direction along the slider rods 12 and 14 to the right hand side of the printer where the service station is located. Also shown are the service station assembly 47 and the service station carriage 24 holding only one rather than four service modules 20 again for the sake of clarity and the optical sensor 17.

Referring now to FIGS. 10, 11A, 11B and 12, the optical sensor 17 includes a photocell 420, holder 422, cover 424, lens 426, and light source such as two LEDs 428, 430. A unitary light tube or cap 432 has a pair of notched slots 434 which engage matching tabs on a lower end of the holder 422 upon insertion and relative rotation between the cap and the holder. The two LEDs are held in opposite apertures of the two shoulders 438 which have a size slightly less than the outside diameter of the LEDs, to prevent the LEDs from protruding into a central passageway which passes through the holder to the photocell. A protective casing 440 which also acts as an ESD shield for the sensor components is provided for attachment to the carriage as well as for direct engagement with the shoulders of the light tube. Additional details of the function of a preferred optical sensor system are disclosed in copending application Ser. No. 08/551,022 filed Oct. 31, 1995 entitled OPTICAL PATH OPTIMIZATION FOR LIGHT TRANSMISSION AND REFLECTION IN A CARRIAGE-MOUNTED INKJET PRINTER SENSOR, which application is assigned to the assignee of the present application, and is hereby incorporated by reference.

Figure 8:
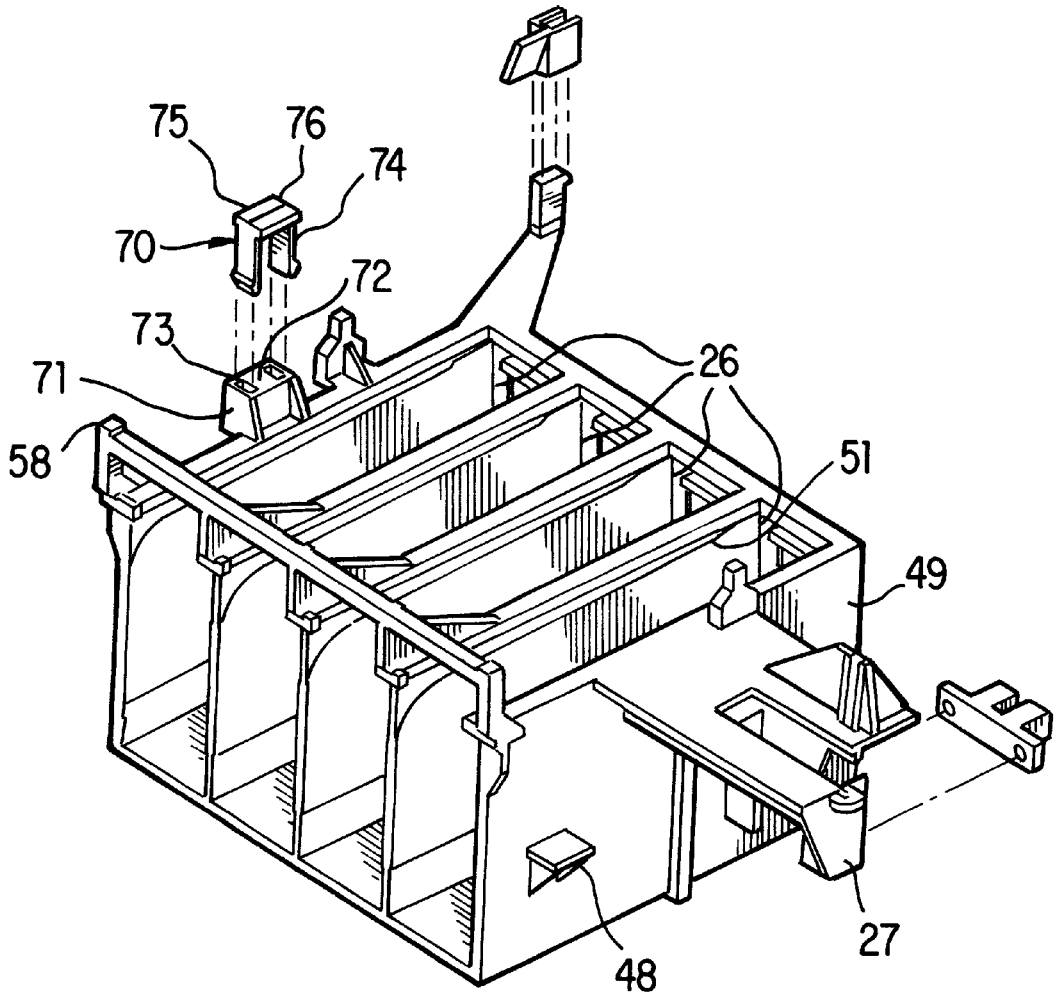
FIG. 8 shows a service station carriage incorporating a reference mark according to an embodiment of the present invention.
Figure 13:
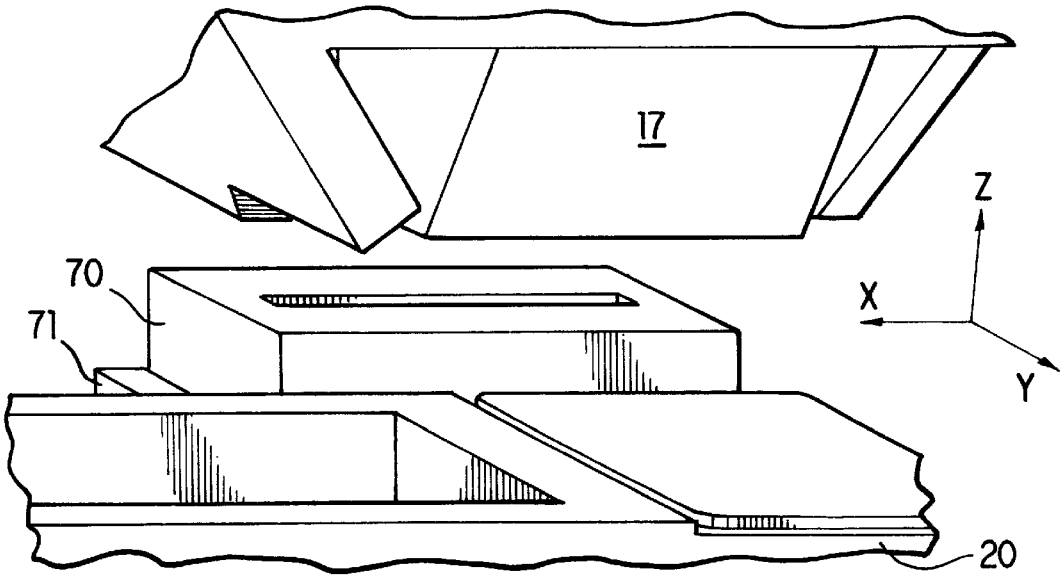
FIG. 13 is an enlarged partial perspective view of a part of the optical sensor and a reference mark according to an embodiment of the invention.

FIGS. 8 and 13 show a two part reference mark formed of an insert 70 and a mount 71 utilised in the presently preferred embodiment of the invention. The reference mark is located on the top of the left hand side wall 49 of the service station carriage 24 approximately midway along the length of the wall. This position is chosen so that the reference mark can be easily moved into the path of the optical sensor 17 as it is moved (on the printer carriage 10) along the slider bars in the Y direction. This movement of the reference mark to a position where it can be utilised for calibration according to the present embodiment is achieved by movement of the service station carriage 24 in the X and Z direction by the service station carriage assembly 47.

Figure 14:
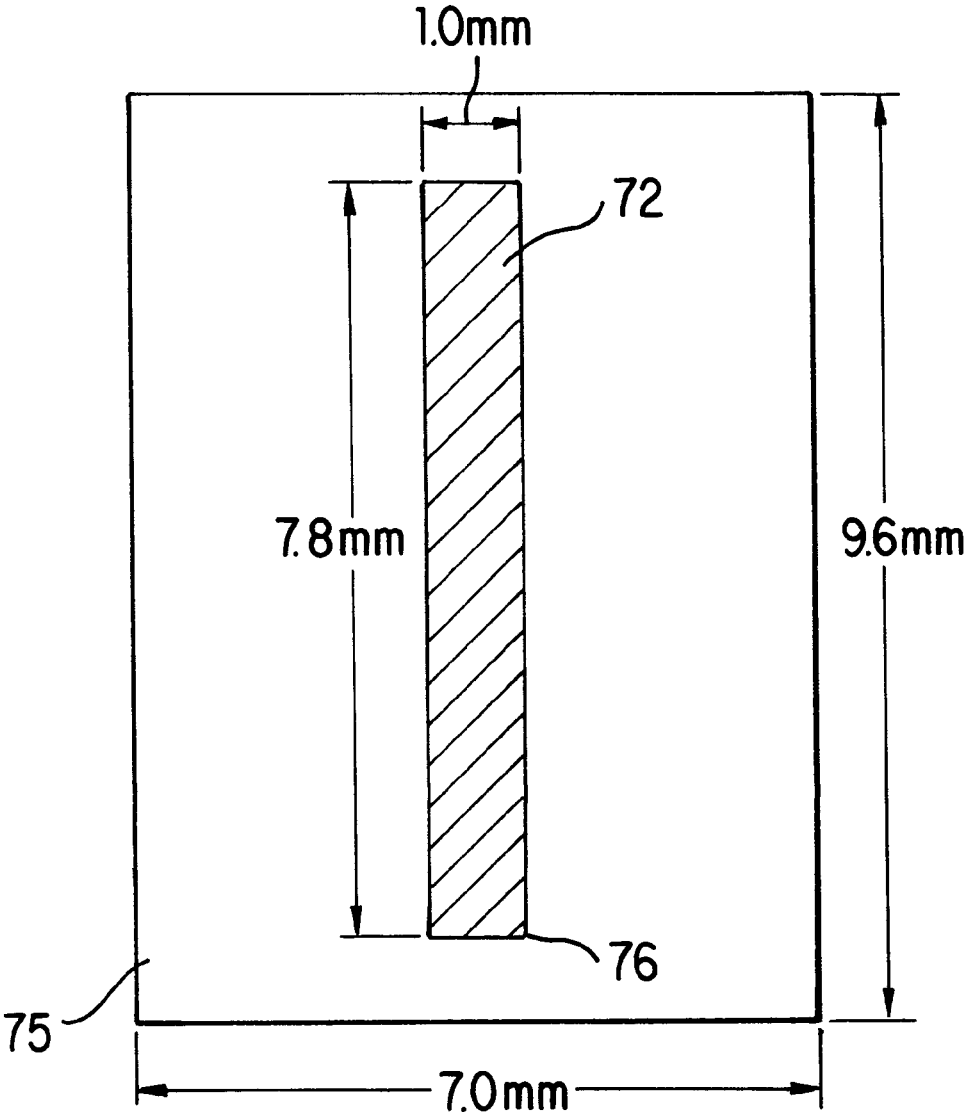
FIG. 14 is a schematic plan view of the reference mark of FIG. 13.

The mount section 71 of the reference mark is formed from the same engineering plastics material as the service station carriage 24 and is black in colour since black has a very low reflectance of light. It extends upwardly away from the wall 49 has a flat upper surface 72 which defines two holes 73. The insert section 70 of the reference mark is formed from a plastics material which is white in colour (due the very high reflectance of white surfaces) and has two legs 74 which extend downwardly away from a flat land section 75 of the insert 70. The flat land 75 defines a rectangular slot 76, best seen in FIG. 14, of dimensions 7.8 mm by 1.0 mm. The land 75 is 9.6 mm by 7.0 mm. The insert 70 can be placed within the mount 71 by inserting the legs 74 into the holes 73 in the mount 71 and is shown in its installed position in FIGS. 10 and at a larger scale in FIG. 13.

Other parts of the service station carriage 24 are chosen to be black in colour to ensure that they do not reflect stray light from the optical sensor since such reflections could provide false signals to the optical sensor.

Figure 15A:
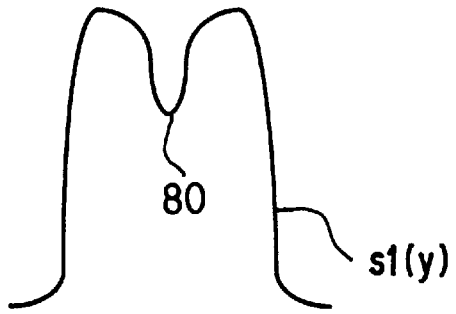
FIG. 15A is a schematic representation of the optical sensor readings taken as an optical sensor is scanned over a reference mark.

As can be seen the longer side of the slot 76 runs perpendicularly to the scanning direction (the Y direction) of the printer carriage 10 so that as the optical sensor 17 of the printer carriage 10 scans past the reference mark the colour change from white to black is "seen" by the sensor (due to the large change in reflectance between a black and a white surface) followed a second colour change from black to white. These reflectance or colour changes generate a set of optical sensor readings of the type shown in FIG. 15 where the value of the sensor reading S is plotted against the Y position of the printer carriage 10 to give the curve labelled s1(y). As will be appreciated the central dip 80 in the curve is due to the optical sensor 17 scanning the black band of the mount 71 within the white background of the insert 70. The minimum of this central dip corresponds to the centre of the reference mark and the Y coordinate of this location of the printer carriage is what is sought by the following procedures. Three alternative procedures called A1, A2 and A3 for determining the y position of the turning point 80 of the central dip will be described with reference to FIGS. 16, 17 and 18.

Figure 15B:
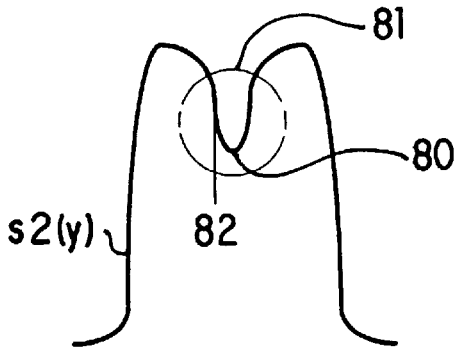
FIG. 15B is a schematic representation of the averaged values of the readings of FIG. 15A.
Figure 16:
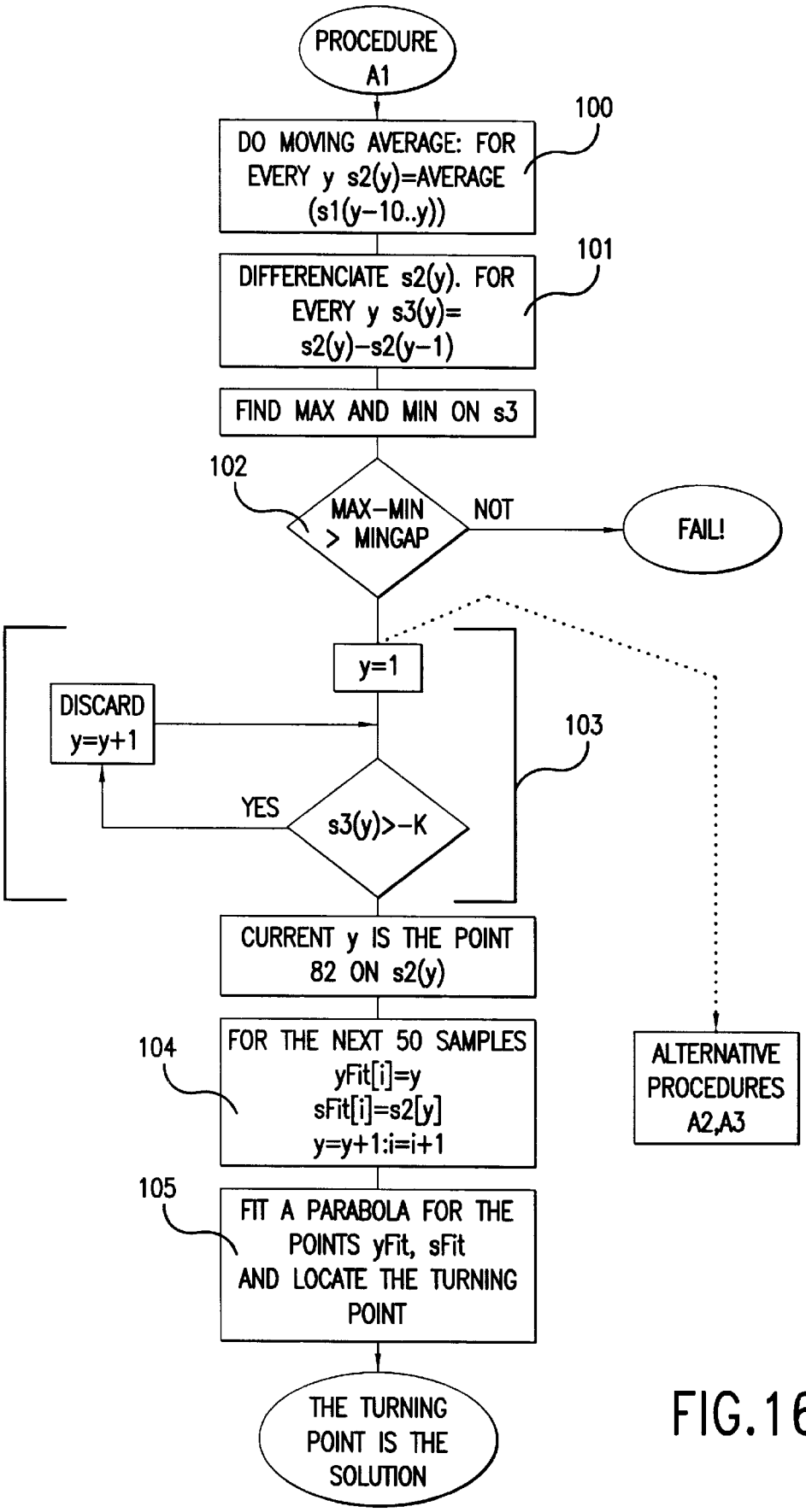
FIG. 16 is a flowchart showing a first procedure for locating the centre of a reference mark.

The flowchart shown in FIG. 16 depicts a first procedure, called A1, which commences by taking a moving average of the raw sensor readings (step 100) in which each particular reading is replaced by the mean of the five sensor readings either side of it resulting in the curve s2(y) shown in FIG. 15B. The y coordinate of the point 80 on s2(y) is then found by fitting a parabola to the area of the curve labelled by circle 81. First, however the starting point for fitting the parabola, labelled as 82, must be found.

Figure 15C:
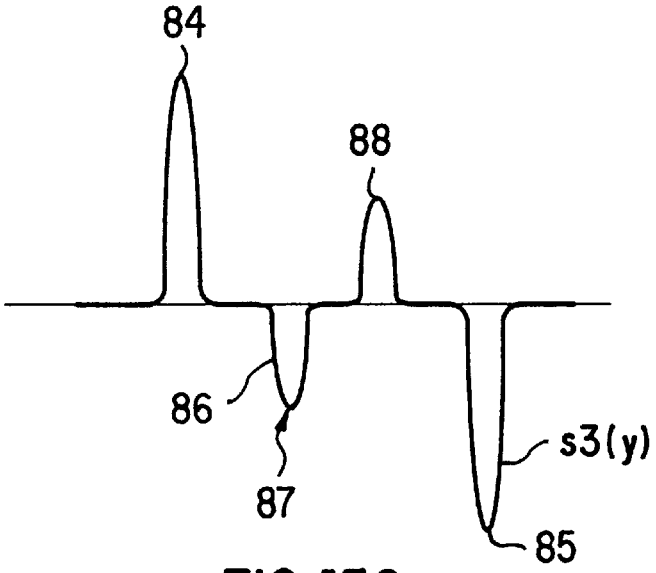
FIG. 15C is a schematic representation of the differential of the averaged values of the readings of FIG. 15B.

To facilitate this the curve labelled s2(y) is differentiated (step 101) to yield the curve labelled s3(y) shown in FIG. 15C, since the differential function is likely to be less affected by noise than the original readings. A check (step 102) is then performed on the differential function to ensure that this set of readings are valid. The maximum 84 and minimum 85 of the differential function s3(y) are found and the difference between these figures is compared to an empirically determined value minGap. If the difference is greater than minGap, procedure A1 is continued, if not the sensor readings are discarded and the procedure is restarted. If this check is repeatedly failed, an error message is given to the operator. Since the maximum and minimum values correspond to the edges of the reference mark, this check should ensure that there is a reference mark mounted on the service station carriage 24, that it is has been correctly positioned for calibration and that the reference mark has been correctly "read" by the optical sensor. Once this check has been passed, starting from the lower values of s3(y), all values that are greater than an empirically determined value −k are discarded until the value −k is encountered (step 103). The value of −k is chosen by trial and error to give a point 86 on the s3(y) curve which is approximately halfway down the smaller minimum as shown in FIG. 15C.

The precise location of the point 86 is not critical to procedure A1 since it merely determines the starting point for the fitting of the parabola. This starting point, determined from the differential curve s3(y), is then used to fit a parabola to the s2(y) curve (step 104). The turning point of the parabola is then found by standard means (step 105). Although a parabola has been chosen for simplicity, it should be noted that any standard function with a turning point can be utilised.

Figure 17:
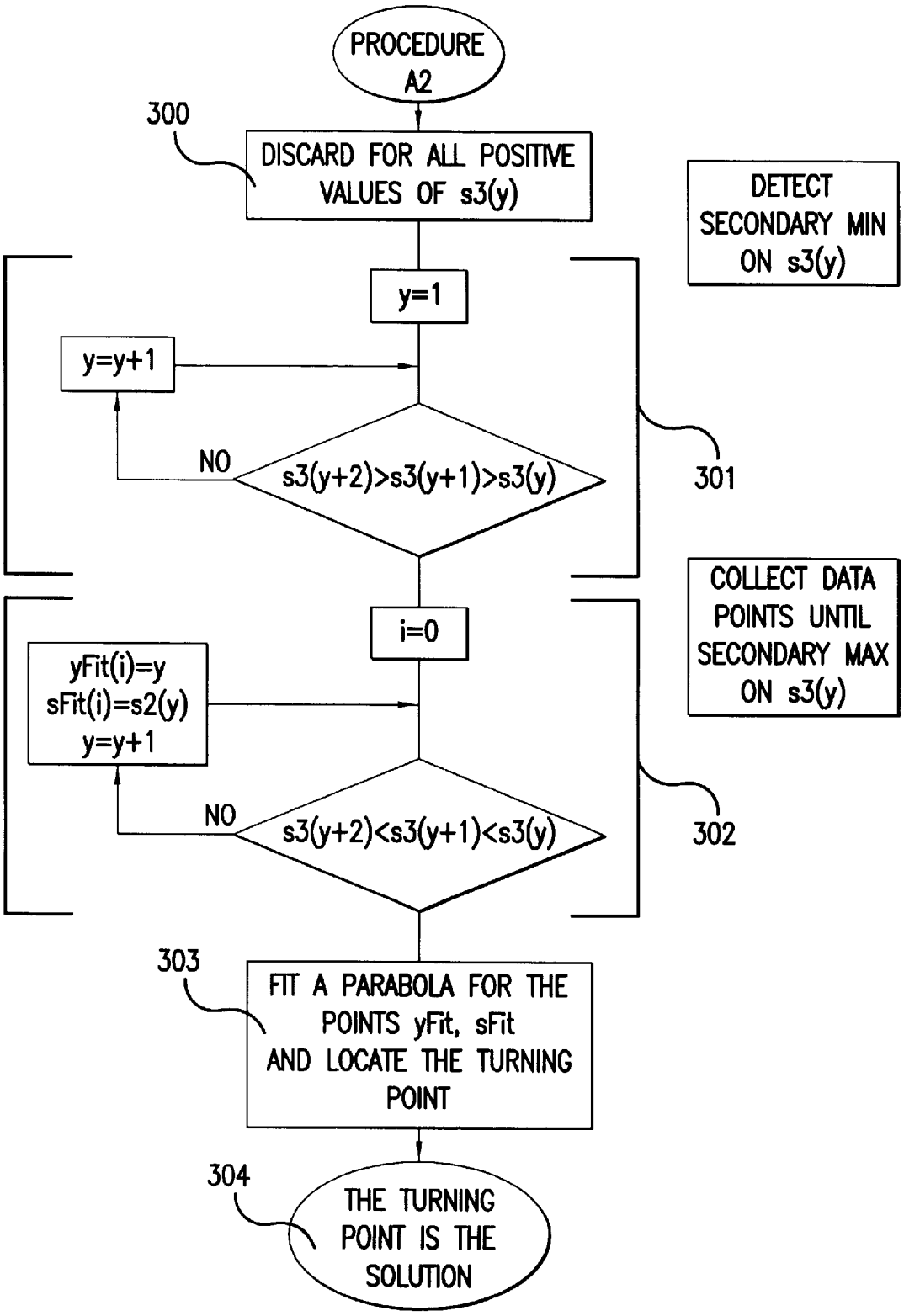
FIG. 17 is a flowchart showing a second procedure for locating the centre of a reference mark.

An alternative procedure, A2, for the determination of the turning point 80 of s2(y) will now be described, with reference to FIGS. 16 and 17. The first part of procedure A2 is identical to A1, that is steps 100, 101 and 102 of A1 are carried out for A2 as shown in FIG. 16. Then, having obtained curve s3(y), procedure A2 employs a different technique to determine the point 80 as shown in FIG. 17. Firstly, all positive values of s3(y) are discarded in step 300, then the values of s3(y) are compared (for increasing values of y) to the nearest and next nearest values of s3(y) to determine when the turning point 87 of the s3(y) curve shown in FIG. 15C is reached. From this point forward values of s2(y) are collected until the turning point 88 of the s3(y) curve is reached step 302. In step 303 the values of s2(y) collected between the points 87 and 88 of the s3(y) curve are fitted to a parabola and the turning point of the parabola is determined. Procedure A2 thus provides an alternative technique to procedure A1 for determining the data points to which a parabola is to be fitted which in some circumstances may be more accurate than the technique of A1. A further advantage of A2 is that it does not require the empirical value −k to be determined.

Figure 18:
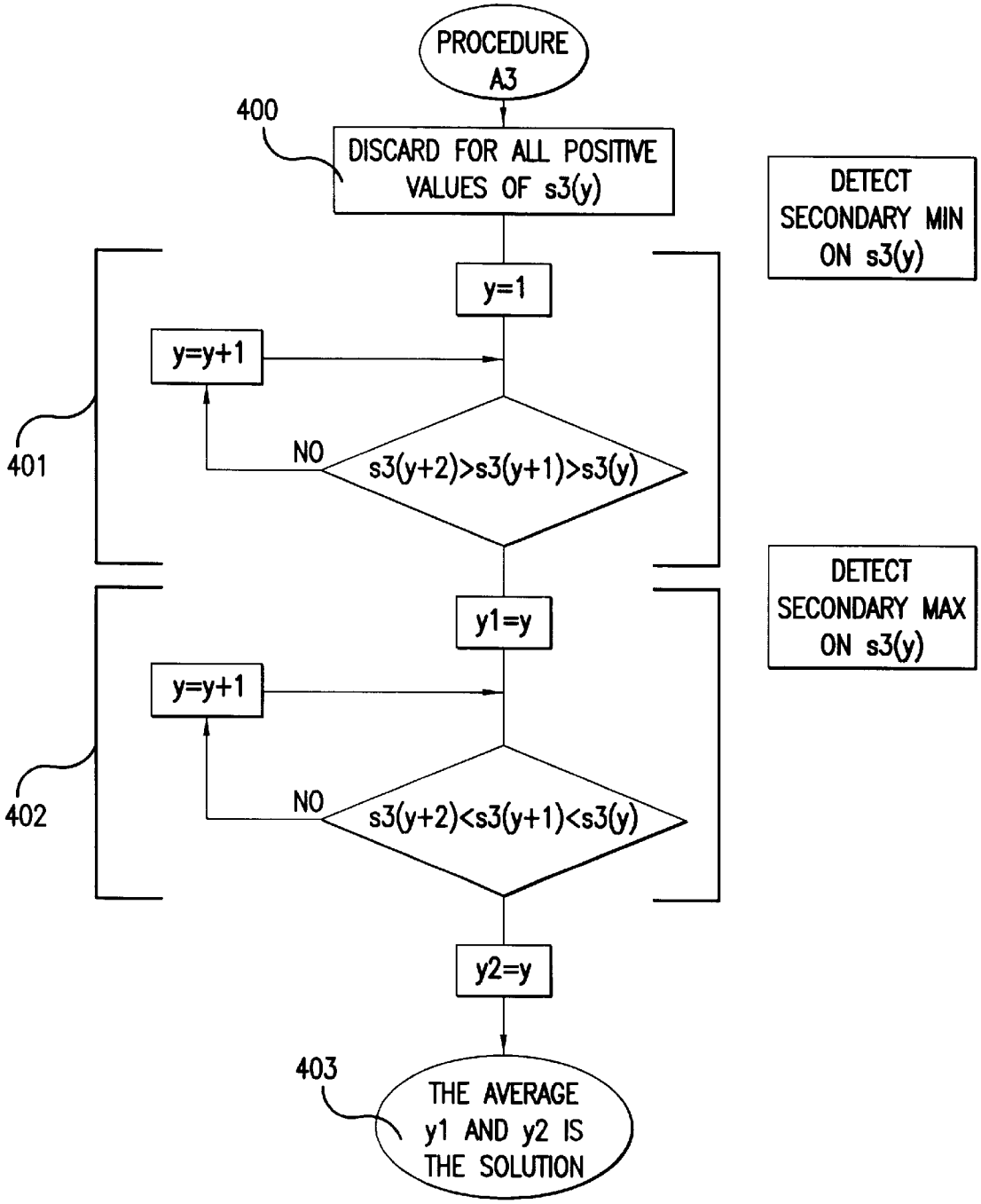
FIG. 18 is a flowchart showing a third procedure for locating the centre of a reference mark.

A further alternative A procedure is shown schematically in the flowchart of FIG. 18. Again, the steps 100, 101 and 102 of A1 are first carried out, then all positive values of s3(y) are discarded in step 400 and the same test as used in procedure A2 step 301 is utilised in step 401 to determine the y position of the turning point 87 of the s3(y) curve which is stored as y1. The same test as used in procedure A2 step 302 is then utilised in step 402 to determine the y position of the turning point 88 of the s3(y) curve which is stored as y2. In this case no data points are collected between y1 and y2, but instead the mean of y1 and y2 is calculated and this mean value is taken as the y position of the turning point 80 of s2(y). Procedure A3 thus a simpler technique which does not require the fitting of a curve to s2(y) data points and the determination of the turning point of such a curve.

The use of one of the A procedures (A1, A2 or A3) results in a single determination of the location of the optical sensor 17, and thus the printer carriage 10, relative to the reference mark on the service station carriage 24. However, due to noise in the optical sensing system and potential movement in the resilient components of the service station eg the springs 57 of the service station carriage 24, it is preferable to perform the location calibration several times and to take an average of the resulting location determinations. An important aspect of these repeated calibrations is that between each calibration the service station 24 should cap the cartridges 16 held by the printer carriage 10. This ensures that the resilient components of the service station are compressed and released several times and thus should facilitate accurate location calibration.

Figure 19:
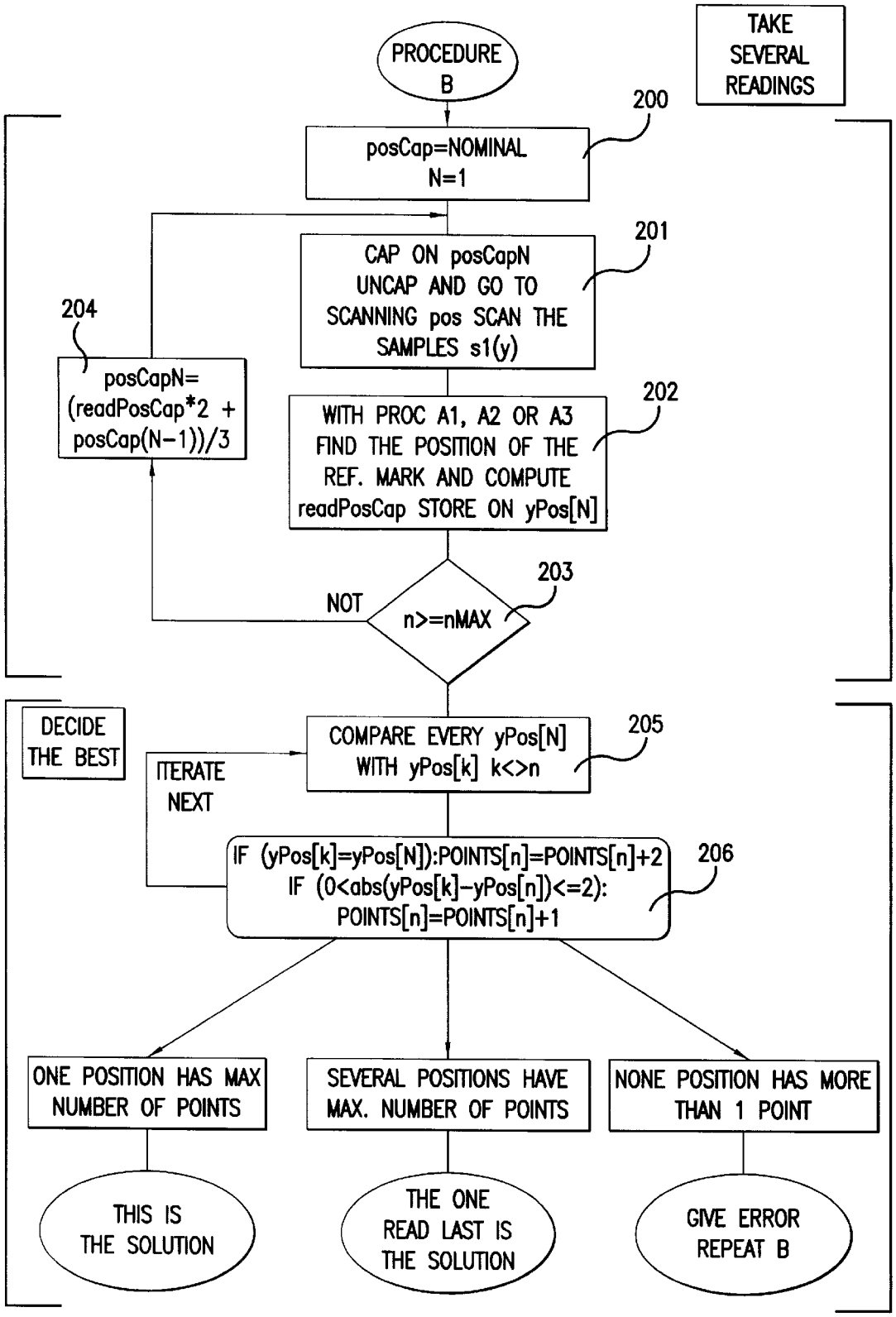
FIG. 19 is a flowchart showing an iterative procedure for improving the accuracy of the location of the reference mark.

With reference to the flowchart of procedure B shown in FIG. 19, steps 201, 202 203 and 204 show the calibration procedure A (A1 or A2 or A3) being carried out nMax times with a capping and uncapping step 201 between each. The first capping operation is carried out with only a knowledge of the nominal location of the caps but subsequently step 204 ensures that, prior to each capping step, the most recent information on the correct location of the caps relative to the printer carriage is utilised in each capping operation. In fact a weighted average of the most recent cap position and the previous cap positions is taken so that iteratively better capping positions are used during the location calibration.

Once all the iterations have been performed (nMax is typically between 10 and 20), the resulting set of location calibrations must be averaged to yield a final calibration to be stored in the printer for future use. Modal rather than mean averages are preferred since they ensure that aberrant calibration values are not give any weight. However, rather than perform a simple modal average it has been found to be advantageous to perform a modified modal average in which the nearest and next nearest neighbouring position calibrations are given some weight in the average. Thus, each position calibration is compared with every other one and each position calibration is awarded two points for every other position calibration it is identical to, and one point for every other position calibration it is within two position locations of (see steps 205 and 206)

If only one position calibration has the maximum number of points this is the one that is utilised. If more than one position calibration have an equal maximum number of points then the last position calibration that was measured is utilised. This is because the last one is most likely to represent the current settlement position of resilient components of the system. If none of the measured calibration positions has more than one point, then the calibrations are discarded and procedure B is repeated.

The present technique for aligning a printer carriage with a service station in the carriage scan axis may be utilised at any convenient moment during the operation of the printer to check or recalibrate the location of the printer carriage to the service station. Alternatively, or additionally, the technique may be utilised when a service station component or a component affecting the Y axis of the printer (e.g. the encoder strip) is replaced or serviced. Alternatively, or additionally, the technique may be utilised during the construction or initial assembly of the printer in which case the final calibration is stored within the printer and utilised for the lifetime of the printer.

What is claimed is:

1. A method of locating a scanning printer carriage of an inkjet printer relative to a service station positioned at one end of the scanning axis of the printer carriage comprising the steps of:

activating an optical sensor mounted on the printer carriage;

moving the printer carriage along in its scanning direction while optically sensing for a reference mark located on the service station and while monitoring the current position of the printer carriage along its scanning axis by an optical encoder;

locating the reference mark;

storing the current position of the printer carriage at which the reference mark has been located; and calculating from a known distance of the reference mark to servicing components of the service station and from a known distance of the optical sensor to cartridges held within the printer carriage, to determine the relative location of the cartridges to the servicing components.

2. A method of locating a scanning printer carriage of an inkjet printer relative to a service station positioned at one end of the scanning axis of the printer carriage comprising the steps of:

activating an optical sensor mounted on the printer carriage;

moving the printer carriage along in its scanning direction while optically sensing for a reference mark located on the service station and while monitoring the current position of the printer carriage along its scanning axis by an optical encoder;

locating the reference mark;

storing the current position of the printer carriage at which the reference mark has been located; and wherein the step of locating the reference mark comprises the further steps of:

storing within a processor the readings taken by the optical sensor when moved past the reference mark as a function of the position of the printer carriage, calculating the differential of the stored readings and storing the differential as a differential function, employing the differential function to determine the turning point of the stored readings function, and storing the position of the printer carriage at the turning point as the location of the reference mark.

3. A method as claimed in claim 2, wherein the differential function is employed in the following manner:

the stored differential function values are compared with a threshold value to determine the approximate location of a turning point of the stored sensor readings function and the optical sensor readings are discarded for a fixed distance either side of the turning point, a standard function curve is fitted to the remaining stored readings and the position of a turning point of the said standard function curve is determined, the position of the printer carriage at this turning point is stored as the location of the reference mark.

4. A method as claimed in claim 2, wherein the differential function is employed in the following manner:

two turning points of the differential function are determined and a standard function curve is fitted to the stored sensor readings located between the two said turning points, the position of a turning point of the said standard function curve is determined, the position of the printer carriage at this turning point is stored as the location of the reference mark.

5. A method as claimed in claim 2, wherein the differential function is employed in the following manner:

two turning points of the differential function are determined the mean value of the location of the two said turning points is calculated, the said mean value is stored as the location of the reference mark.

6. A method of locating a scanning printer carriage of an inkjet printer relative to a service station positioned at one end of the scanning axis of the printer carriage comprising the steps of 1) activating an optical sensor mounted on the printer carriage, 2) moving the printer carriage in a scanning direction along the scanning axis while optically sensing for a reference mark located on the service station and while monitoring the current position of the printer carriage along the scanning axis by an optical encoder, 3) locating the reference mark, 4) performing a capping operation in which the cartridges held within the printer carriage are capped by caps within the service station, 5) uncapping the cartridges, 6) repeating steps 2) to 5) an additional N number of times which respects to the current position 7) storing an average of the N+1 values of the current position of the printer carriage at which the reference mark has been located in step 3).

7. A method as claimed in claim 6, wherein prior to each performance of step 4) the following step is carried out:

8) calculating from the location of the reference mark found in step 3) the location of the caps within the service station, and wherein the result of step 8) is utilised to more accurately perform the capping operation in step 4).

8. A method as claimed in claim 6, wherein the average stored in step 7) is the modal average of the N+1 values of the position of the printer carriage.

9. A method as claimed in claim 6, wherein in step 7) the position of the printer carriage stored for future use is a modified modal average of the N+1 positions measured which is calculated by weighting each measured position by the number of immediate and once removed neighbouring positions that are measured.

* * * * *